US009084918B2

(12) United States Patent
McNamee

(10) Patent No.: US 9,084,918 B2
(45) Date of Patent: Jul. 21, 2015

(54) FOOTBALL WITH SEGMENTED COVER PANELS

(75) Inventor: Mark McNamee, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 56 days.

(21) Appl. No.: 13/484,338

(22) Filed: May 31, 2012

(65) Prior Publication Data

US 2013/0324333 A1 Dec. 5, 2013

(51) Int. Cl.
*A63B 41/08* (2006.01)

(52) U.S. Cl.
CPC ..... *A63B 41/08* (2013.01); *A63B 2243/007* (2013.01); *A63B 2243/0066* (2013.01)

(58) Field of Classification Search
CPC ..... A63B 41/08; A63B 2243/007; A63B 2243/0066
USPC ..... 473/596–599, 603–605
See application file for complete search history.

(56) References Cited

U.S. PATENT DOCUMENTS

| | | | | | |
|---|---|---|---|---|---|
| 601,520 | A | | 3/1898 | Longden | |
| 1,151,396 | A | | 8/1915 | Roberts | |
| 1,240,866 | A | | 9/1917 | Miller | |
| 1,299,299 | A | | 4/1919 | Chamberlin | |
| 1,502,784 | A | | 7/1924 | Kennedy | |
| 1,556,099 | A | | 10/1925 | Gilson | |
| 1,559,117 | A | * | 10/1925 | Maynard | 473/596 |
| 1,597,308 | A | | 8/1926 | Brandt | |
| 1,994,703 | A | | 3/1935 | Hawes | |
| 2,011,760 | A | * | 8/1935 | Gallinant | 473/596 |
| RE20,036 | E | | 7/1936 | Baumer | |
| 2,061,604 | A | | 11/1936 | Winterbauer | |
| 2,245,115 | A | | 6/1940 | Reach | |
| 2,280,314 | A | | 4/1942 | Scudder | |
| 2,317,939 | A | | 4/1943 | Riddell | |
| 2,325,128 | A | * | 7/1943 | Grady | 473/597 |
| 2,448,731 | A | * | 9/1948 | Park | 473/596 |
| 2,859,040 | A | * | 11/1958 | Gow et al. | 473/596 |
| 3,506,265 | A | * | 4/1970 | Hiroshi | 473/604 |
| 3,887,416 | A | * | 6/1975 | Tebbetts, Jr. | 156/156 |
| 4,660,831 | A | | 4/1987 | Kralik | |
| 4,869,504 | A | | 9/1989 | Kralik | |

(Continued)

FOREIGN PATENT DOCUMENTS

| | | |
|---|---|---|
| CN | 200995038 | 12/2007 |
| JP | 4208171 | 7/1992 |
| JP | 11299950 | 11/1999 |

OTHER PUBLICATIONS

International Search Report and Written Opinion cited in PCT/US2013/043231, dated Sep. 26, 2013.

(Continued)

*Primary Examiner* — Steven Wong
(74) *Attorney, Agent, or Firm* — Plumsea Law Group, LLC

(57) ABSTRACT

A prolate spheroidal inflatable game ball in the form of a football is provided with a segmented panel having stripes formed by attaching stripe pieces to adjacent segments. In one embodiment, the stripe pieces have beveled edges and the edges of adjacent segments have corresponding beveled edges. The component pieces of the panel can be joined to the stripe pieces using stitching to securely fasten the components of the segmented panel together. A segmented panel of this construction can allow different materials having different characteristics to be used for various portions of the segmented panel.

19 Claims, 12 Drawing Sheets

(56) References Cited

U.S. PATENT DOCUMENTS

| | | | | |
|---|---|---|---|---|
| 4,928,962 | A * | 5/1990 | Finley | 473/596 |
| 5,542,662 | A * | 8/1996 | Kouzai et al. | 473/605 |
| 5,681,233 | A * | 10/1997 | Guenther et al. | 473/605 |
| 5,779,578 | A | 7/1998 | Calandro | |
| 5,931,752 | A | 8/1999 | Guenther et al. | |
| 6,200,239 | B1 * | 3/2001 | Kennedy et al. | 473/604 |
| 6,331,151 | B2 | 12/2001 | Calandro | |
| D457,208 | S | 5/2002 | Murphy et al. | |
| 6,402,647 | B1 | 6/2002 | Haseltine | |
| 6,422,961 | B1 | 7/2002 | Feeney | |
| 6,461,461 | B2 | 10/2002 | Kennedy, III | |
| D480,774 | S | 10/2003 | Murphy et al. | |
| 6,629,902 | B2 | 10/2003 | Murphy et al. | |
| 6,656,067 | B2 | 12/2003 | Ou | |
| 6,663,520 | B2 | 12/2003 | Ou Chen | |
| 6,722,889 | B1 | 4/2004 | Page et al. | |
| 6,726,583 | B1 | 4/2004 | Lai | |
| 6,767,300 | B2 | 7/2004 | Murphy et al. | |
| 6,964,625 | B2 | 11/2005 | Murphy et al. | |
| 7,029,407 | B2 * | 4/2006 | Lee et al. | 473/597 |
| 7,427,246 | B2 | 9/2008 | Taniguchi et al. | |
| 7,470,203 | B1 | 12/2008 | Stillinger | |
| 7,740,782 | B2 | 6/2010 | Ou | |
| 7,749,116 | B2 | 7/2010 | Tang et al. | |
| 8,460,135 | B2 * | 6/2013 | Guenther et al. | 473/597 |
| 2002/0025866 | A1 | 2/2002 | Thomas | |
| 2005/0245335 | A1 | 11/2005 | Frisina | |
| 2006/0046879 | A1 * | 3/2006 | Kelly et al. | 473/603 |
| 2006/0211527 | A1 * | 9/2006 | Guenther et al. | 473/597 |
| 2007/0010360 | A1 | 1/2007 | Chang | |
| 2007/0129188 | A1 * | 6/2007 | Maziarz et al. | 473/603 |
| 2008/0287230 | A1 | 11/2008 | Guenther et al. | |
| 2011/0237368 | A1 | 9/2011 | Lin | |
| 2013/0231206 | A1 * | 9/2013 | Guenther et al. | 473/597 |

OTHER PUBLICATIONS

International Preliminary Report on Patentability (including Written Opinion of the ISA) mailed Dec. 11, 2014 in International Application No. PCT/US2013/043231.

* cited by examiner

FOOTBALL WITH SEGMENTED COVER PANELS

BACKGROUND

The present invention relates generally to inflatable game balls, and more specifically, to a football with segmented cover panels joined by beveled edge stripe pieces.

Inflatable game balls, including basketballs, footballs, soccer balls, and volleyballs, are well known in the art and typically include an outside cover with an inflatable bladder on the inside. Specifically with respect to American footballs, the outside cover is formed of one or more panels made of hide, plastic, or fabric stitched or otherwise secured to one another. The inflatable bladder is then filled with air to inflate the football.

Traditionally, on most footballs, an area called the laces, or lace element, joins together the panels at an opening used to insert the bladder into the interior of the outside cover. In addition, the laces can assist a user in properly positioning his or her hands to throw the football. The lace element may provide additional gripability and can assist the user in determining the proper pressure to apply to create an appropriate spiral on the ball.

Many footballs include covers having some sort of indicia placed thereon. For example, a manufacturer may place its name, logo, or other identifying indicia on the cover that would assist a user in determining the source of the football. In addition, indicia relating to the characteristics of the football may be included. For example, a manufacturer may include indicia stating whether the football is of the regulation size under the rules of varying agencies, such as under NCAA or high school rules. Finally, other details, such as the appropriate inflation pressure, could be noted on the ball.

Many footballs commonly include a white stripe extending half way around the football on each side of a transverse axis in accordance with the rules of varying agencies, such as under NCAA rules or high school rules of various states or clubs. Specifically, the NCAA rulebook requires two 1-inch white stripes that are three to three and one-quarter inches from the end of the football and located only on the two panels adjacent to the laces. Other agencies can have different requirements for the placement of stripes on the cover of the football.

Conventionally, paint or other coating materials have been used to add stripes to the cover of a football. Other methods have been proposed for adding stripes to a football. U.S. Pat. No. 7,029,407 to Guenther et al. discloses forming a stripe recess into the outer surface of the cover and filling the stripe recess with a thin member.

Therefore, there exists a need in the art for an inflatable game ball having a stripe that is securely fastened with the cover.

SUMMARY

In one aspect, the invention provides a prolate spheroidal inflatable game ball comprising: a cover, the cover comprising a plurality of panels; and an inflatable bladder disposed inside the cover; wherein at least one panel of the plurality of panels includes a stripe piece disposed between an end cone segment and a central body segment along a longitudinal axis; and wherein edges of the stripe piece are joined to an edge of the end cone segment and an edge of the central body segment.

In another aspect, the invention provides a football comprising: an inflatable bladder; a plurality of panels surrounding the inflatable bladder forming a cover; at least two panels of the plurality of panels each including a stripe disposed at either end of the panel; wherein each panel comprises a first stripe piece disposed between a first end cone segment and a central body segment at a first end of the panel and a second stripe piece disposed between a second end cone segment and the central body segment at a second end of the panel; and wherein the first end cone segment, the second end cone segment, and the central body segment are oriented with a length along a longitudinal axis; and wherein the first stripe piece and the second stripe piece are oriented with a length along a transverse axis.

In another aspect, the invention provides a prolate spheroidal inflatable game ball, comprising: an inflatable bladder; a plurality of panels joined together to form a cover; at least one panel of the plurality of panels comprising a segmented panel; the segmented panel comprising a plurality of component pieces joined together to form the segmented panel, the plurality of component pieces including: a first end cone segment disposed at a first end of the segmented panel; a first stripe piece joined to the first end cone segment along a first edge and joined to a central body segment along a second edge; the central body segment extending between the first stripe piece and a second stripe piece; the second stripe piece joined to the central body segment along a third edge and joined to a second end cone segment along a fourth edge; and the second end cone segment being disposed at a second end of the segmented panel.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

The various embodiments described herein relate to an inflatable game ball, particularly, an inflatable game ball in the shape of a prolate spheroid. In an exemplary embodiment, a prolate spheroidal inflatable game ball may be pointed at the ends, for example as is typically used in American football. While the pointedness of an inflatable game ball typically used to play American football, including footballs approved for use in the NFL, NCAA, high school or other leagues, causes it to differ from a true geometric prolate spheroid, such footballs are typically considered to be prolate spheroidal balls, and are encompassed by that term as used herein. In other embodiments, prolate spheroidal inflatable game balls may be configured with shapes that correspond to balls used with other sports, including, but not limited to rugby, Australian rules football, and other sports using a ball having an oblong or elliptical spheroidal shape.

Figure 1:
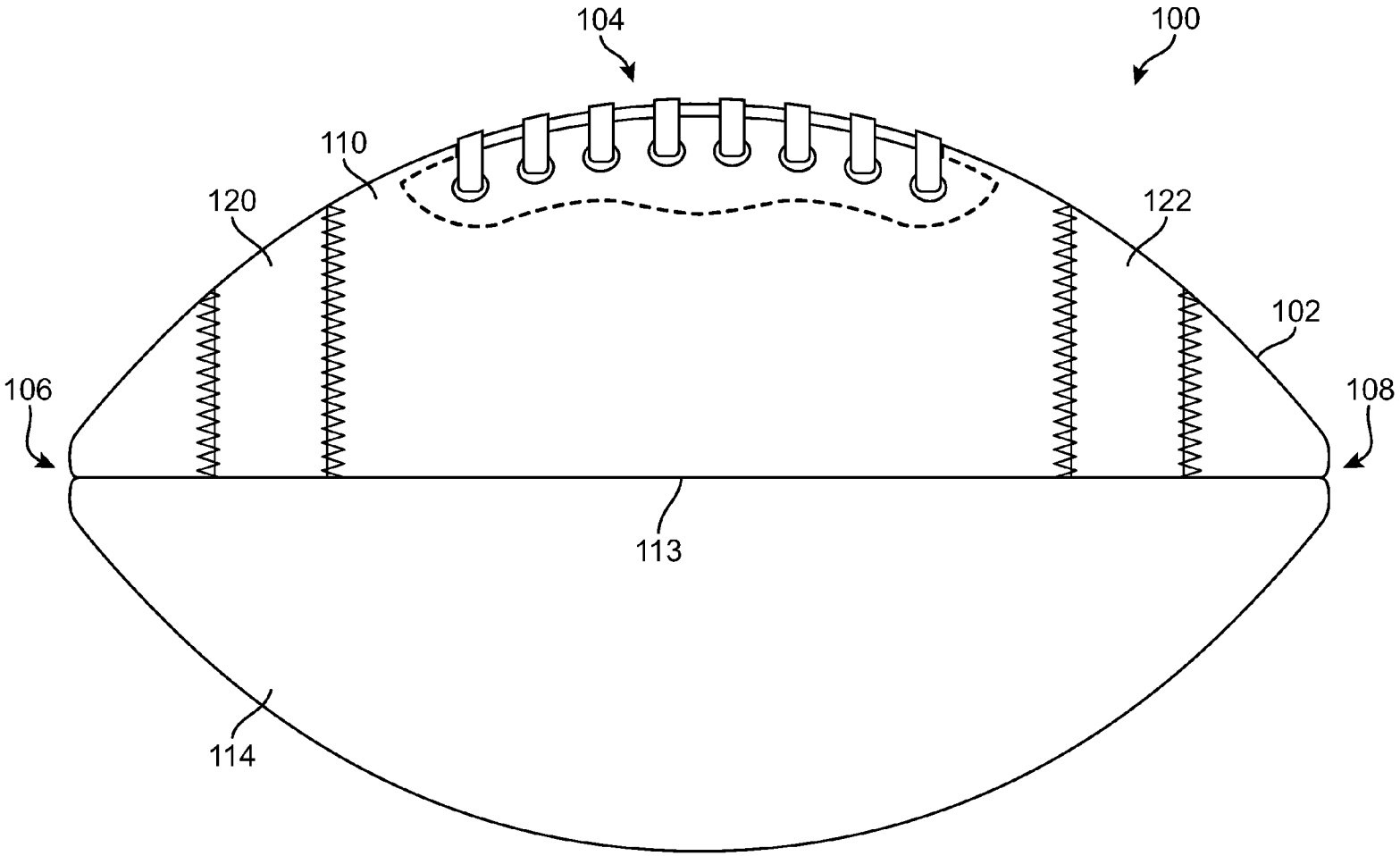
FIG. 1 is a side view of an exemplary embodiment of a football having a segmented cover panel.

FIG. 1 is an exemplary embodiment of a prolate spheroidal ball shown from the side. In this embodiment, the prolate spheroidal ball is a football 100. Football 100 includes a cover 102 and a lace element 104. In an exemplary embodiment, cover 102 may include one or more panels that are sewed or otherwise joined together using adhesive, ultrasonic welding, bonding, or other attachment mechanisms known in the art to form cover 102. In some cases, cover 102 may surround an inflatable bladder 300 (shown in FIG. 3) disposed inside cover 102. The inflatable bladder may be filled with air to a particular pressure level. A variety of pressure levels may be appropriate for a ball for any particular game. In some cases, a conventional inflation valve (not shown) that permits the insertion of a typical needle (not shown) that may be connected to a bicycle pump or other suitable air pump (not shown) may be included to allow air to be introduced into the inflatable bladder. This type of inflation valve may be positioned anywhere desirable or convenient on cover 102 as a designer might select.

In addition, in other cases, football 100 may be formed by attaching one or more panels onto an outer surface of inflatable bladder 300 using adhesive, ultrasonic welding, bonding or other attachment mechanism known in the art.

Generally, cover 102 may be made of any suitable material, including, but not limited to natural and synthetic leather, woven and non-woven fabric, rubber, plastics, or any other materials known in the art.

Lace element 104 may be included as a functional member of football 100, for example to secure parts of adjacent panels of cover 102 to one another. Lace element 104 may also assist a user in correctly positioning his or her hand to pass or grip football 100. In addition, in some cases, lace element 104 may be included to perform a decorative function for football 100. In various embodiments, lace element 104 may be attached to cover 102 in any suitable conventional manner, depending on the materials selected for cover 102 and lace element 104. For example, cover 102 and lace element 104 may both be made from leather and/or synthetic leather and lace element 104 may be inserted into perforations in cover 102. In some embodiments, reinforcements may be included on the perforations in cover 102 to prevent lace element 104 from tearing through cover 102. In another example, cover 102 may be rubber and lace element 104 may be polyvinyl chloride, rubber, silicone, or other thermoplastic elastomers. In some embodiments, an adhesive might be used to adhere lace element 104 to the outside of cover 102.

Football 100 includes a first end 106 and a second end 108 disposed on opposite sides of football 100. In an exemplary embodiment, cover 102 of football 100 may comprise one or more separate panels joined together to form cover 102. In this embodiment, cover 102 includes four panels, including a first panel 110 and a third panel 114. When football 100 is oriented with lace element 104 facing up, first panel 110 is disposed above third panel 114. In some cases, each of the panels making up cover 102 may be joined to an adjacent panel along a seam. In this embodiment, first panel 110 and third panel 114 may be joined along seam 113. In some cases, seam 113 may be an area where the edges of adjacent panels are stitched together or otherwise joined together using adhesive, bonding, ultrasonic welding, or other attachment mechanisms known in the art. The remaining panels disposed on the opposite side of football 100 not visible in FIG. 1 may be similarly joined along substantially similar seams.

In an exemplary embodiment, each of the panels located on the top half of football 100, that is the two panels of football 100 that include lace element 104, may include a stripe near each of first end 106 and second end 108. In this embodiment, first panel 110 includes a first stripe piece 120 disposed near first end 106 and a second stripe piece 122 disposed near second end 108. In various embodiments, the placement and dimensions of the stripes may be configured in accordance with the rules and requirements of different agencies, including, but not limited to the NFL, NCAA, or other agencies. For example, the NCAA rulebook requires two 1-inch white stripes that are three to three and one-quarter inches from the end of the football and located only on the two panels adjacent to the laces. Other agencies can have different requirements for the placement of stripes on the cover of the football. In one embodiment, first stripe piece 120 and second stripe piece 122 may be located on cover 102 from three to three and one-quarter inches from first end 106 and second end 108, respectively, of football 100. In other embodiments, the location and configuration of stripe pieces on cover 102 may be different and/or in accordance with the rules of various agencies.

Figure 2:
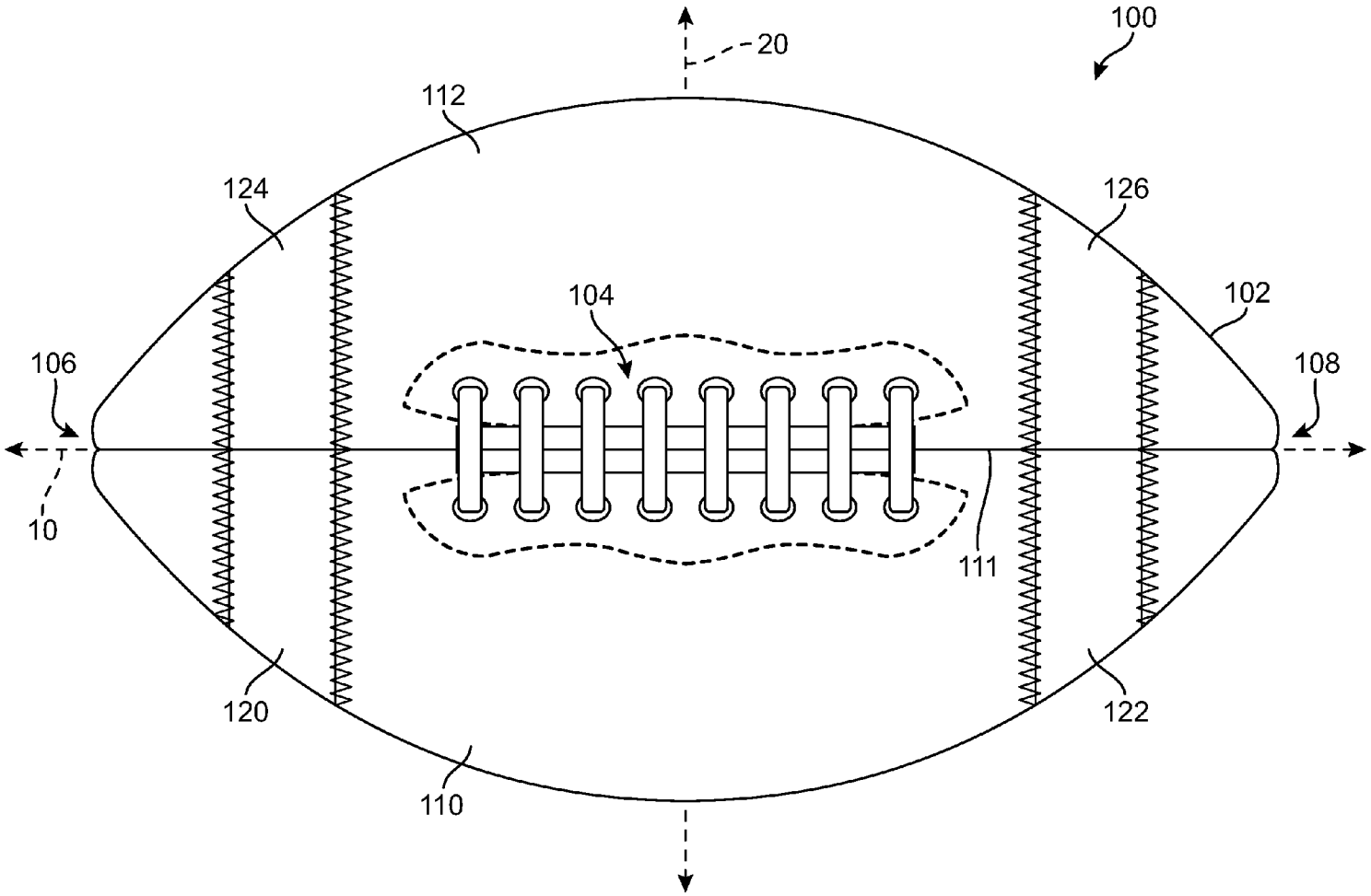
FIG. 2 is a top down view of an exemplary embodiment of a football having segmented cover panels.

Referring now to FIG. 2, a top down view of football 100 is shown. In this view, the top side of football 100 that includes lace element 104 is illustrated. For purposes of reference, football 100 may be described relative to a longitudinal axis 10 extending along the length of football 100 and a transverse axis 20 extending along the width of the football 100, approximately perpendicular to longitudinal axis 10. In addition, football 100 may be described as having a vertical axis (not shown) that extends along the height of football 100 between the top and bottom sides. In this embodiment, lace element 104 is located on the top side of football 100 along the vertical axis and approximately in the center of football 100 along longitudinal axis 10. In addition, each component of football 100, including cover 102 and associated panels, may be similarly described with reference to longitudinal axis 10, transverse axis 20, and the vertical axis.

In this embodiment, first panel 110 and a second panel 112 of cover 102 are shown. First panel 110 and second panel 112 are adjacent to each other and disposed on the top side of football 100. Lace element 104 may span across first panel 110 and second panel 112. As discussed above, in some cases, first panel 110 and second panel 112 may be joined by a seam 111. In an exemplary embodiment, second panel 112 is a complementary mirror image of first panel 110 disposed on the opposite side of football 100. In this embodiment, second panel 112 includes a third stripe piece 124 disposed near first end 106 of football 100 and a fourth stripe piece 126 disposed near second end 108 of football 100. In an exemplary embodiment, third stripe piece 124 may be substantially similar to first stripe piece 120 and fourth stripe piece 126 may be substantially similar to second stripe piece 122.

Figure 3:
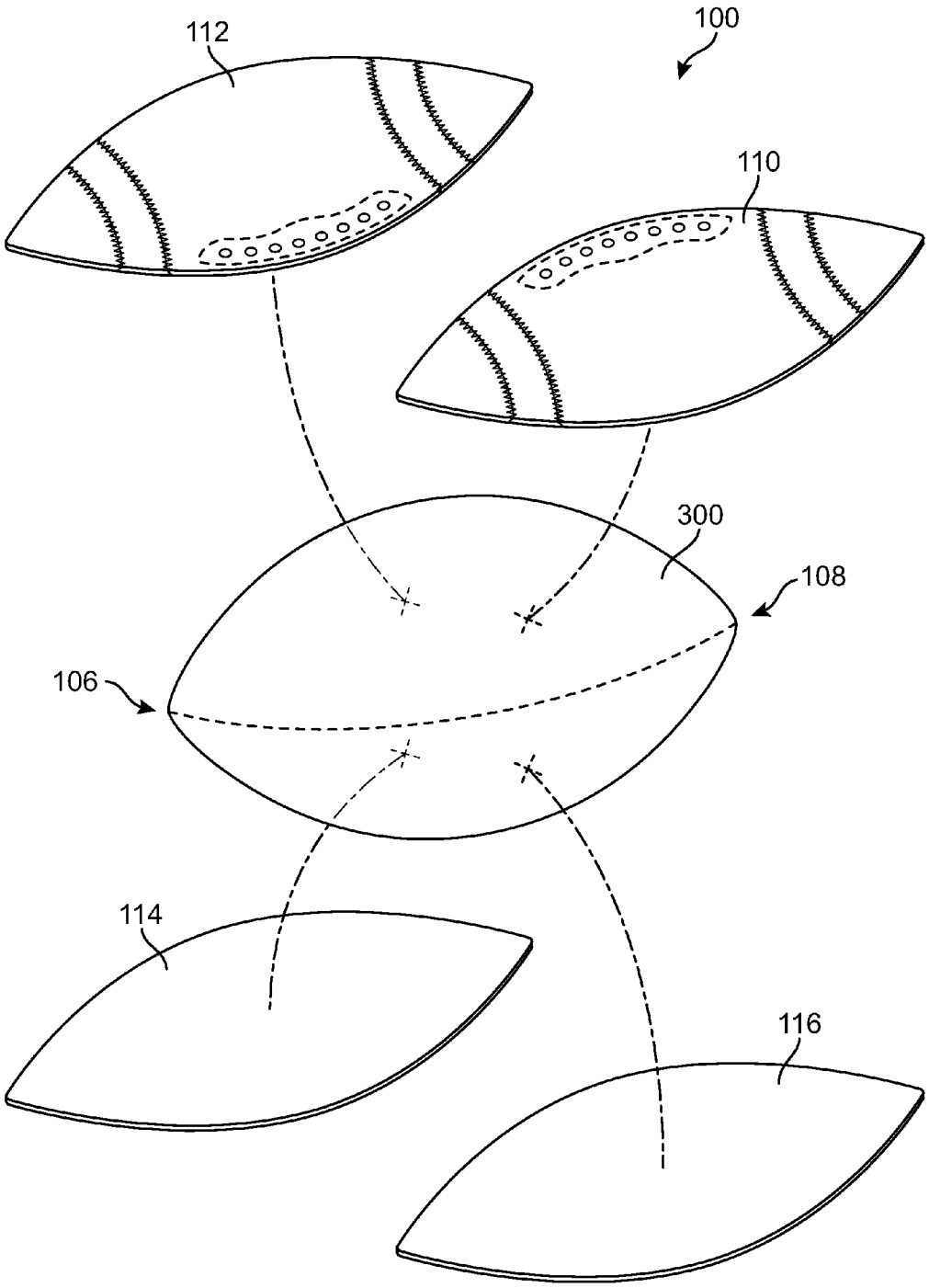
FIG. 3 is an exploded view of an exemplary embodiment of a football having segmented cover panels.

Referring now to FIG. 3, an exploded view of football 100 is illustrated. In an exemplary embodiment, football 100 includes cover 102 surrounding inflatable bladder 300 disposed inside cover 102. As discussed above, bladder 300 is configured to be filled with air to inflate football 100. In this embodiment, the component panels of cover 102 are shown, including first panel 110 and second panel 112 associated with lace element 104 on the top side of football 100 and third panel 114 and a fourth panel 116 on the bottom side of football 100. In some embodiments, each of the panels, including first panel 110, second panel 112, third panel 114, and fourth panel 116 may be joined to an adjacent panel along corresponding edges to form a seam. In some cases, the panels may be joined by stitching. In other cases, the panels may be joined by adhesive, bonding, or any other attachment mechanism known in the art.

Figure 13:
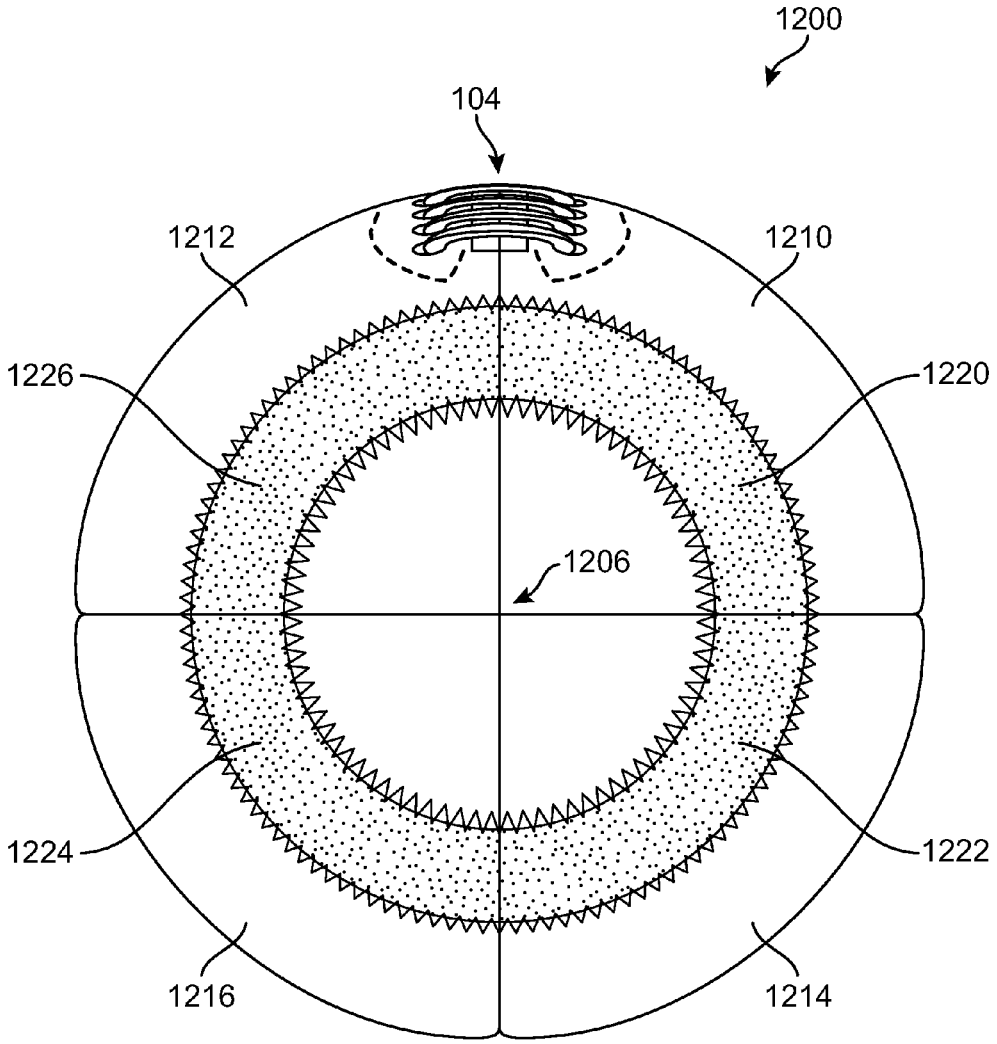
FIG. 13 is an end view of an alternate embodiment of a football having four segmented cover panels.

In an exemplary embodiment, football 100 may include stripes adjacent first end 106 and second end 108 that extend only half way around the circumference of football 100. In this embodiment, first panel 110 and second panel 112 include stripe pieces, described above, while third panel 114 and fourth panel 116 are each substantially monolithic panel portions without stripe pieces. In other embodiments, however, stripes may extend more or less around the circumference of the football, including entirely around the circumference of the football, as shown in the embodiment of FIG. 13 below.

Figure 4:
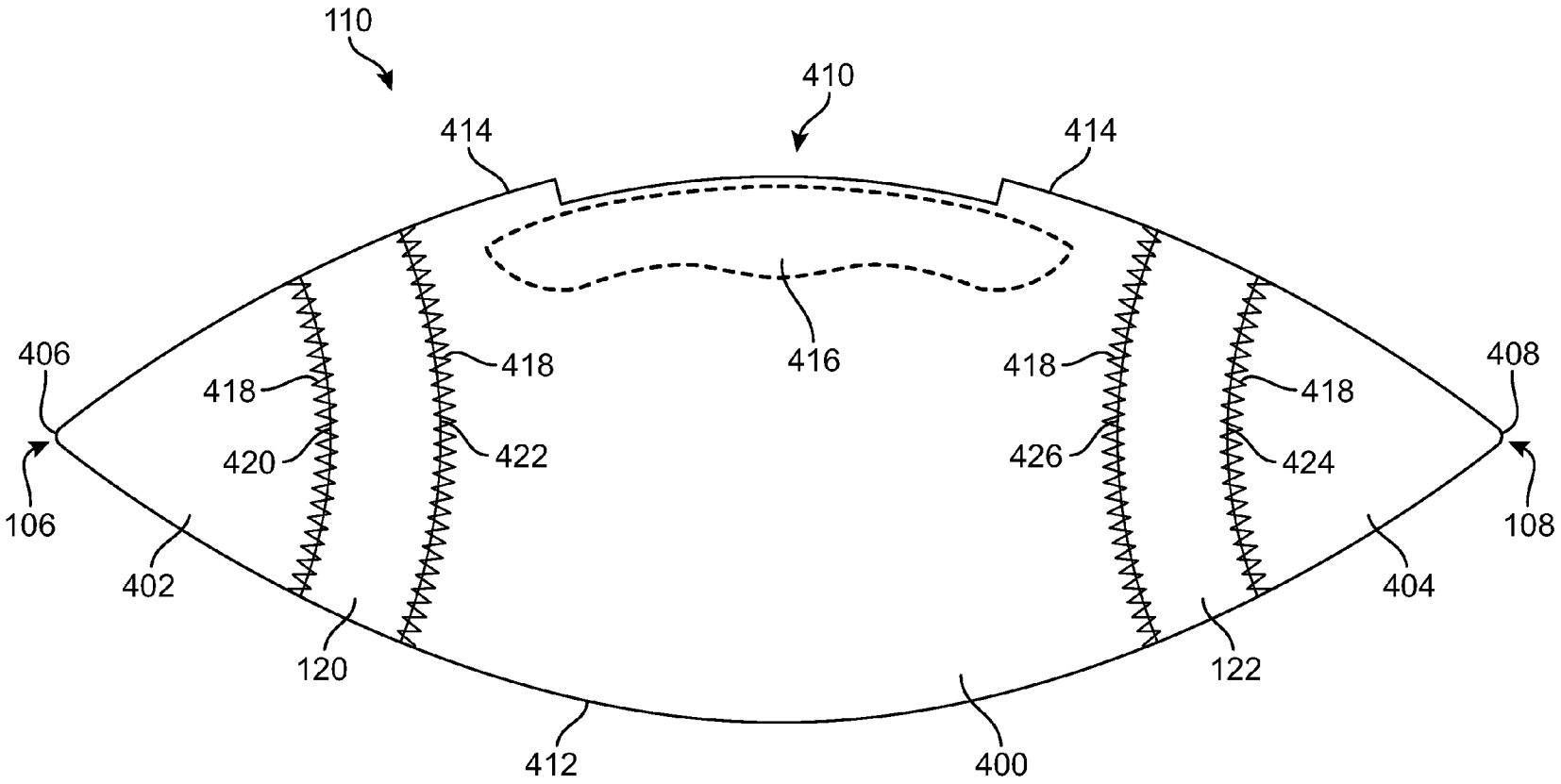
FIG. 4 is a schematic view of an exemplary embodiment of a segmented cover panel.
Figure 5:
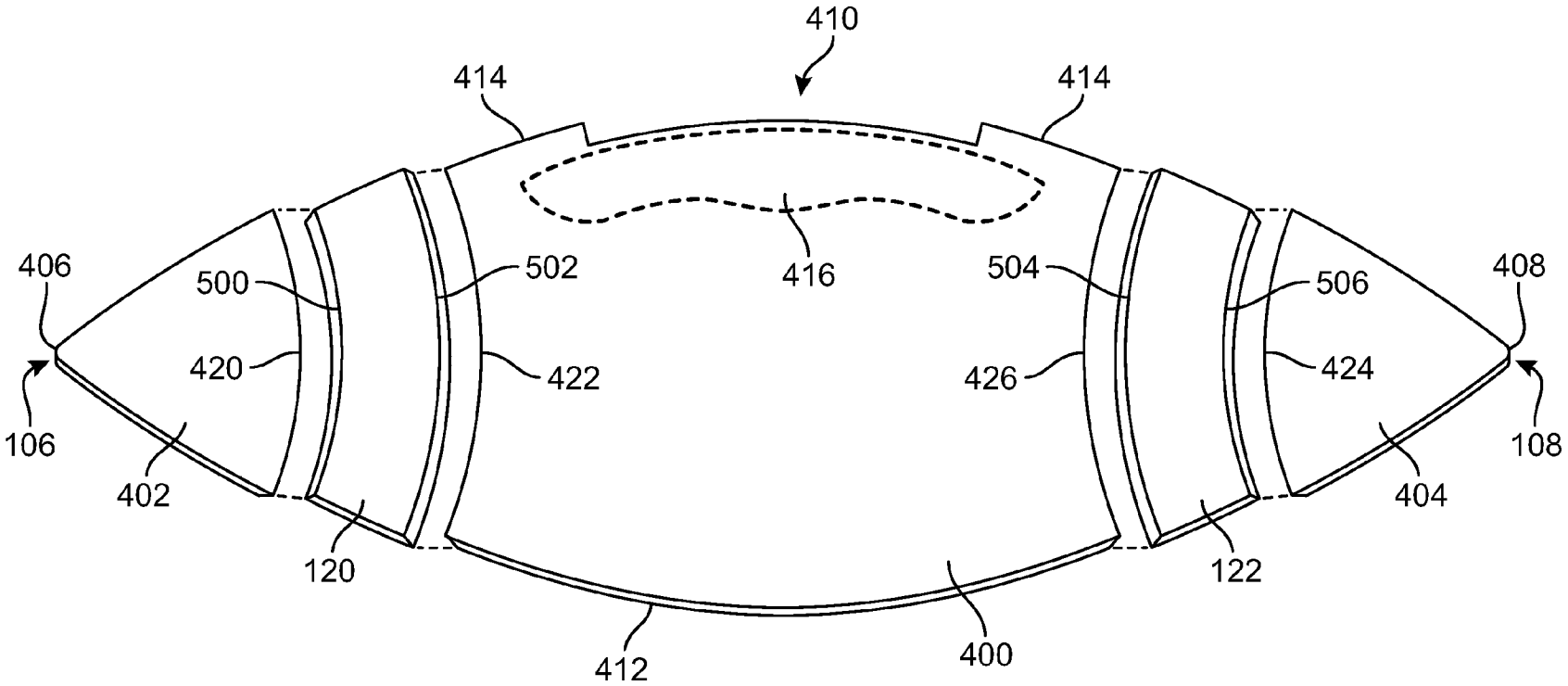
FIG. 5 is an exploded view of an exemplary embodiment of a segmented cover panel showing the beveled edge stripe pieces.
Figure 6:
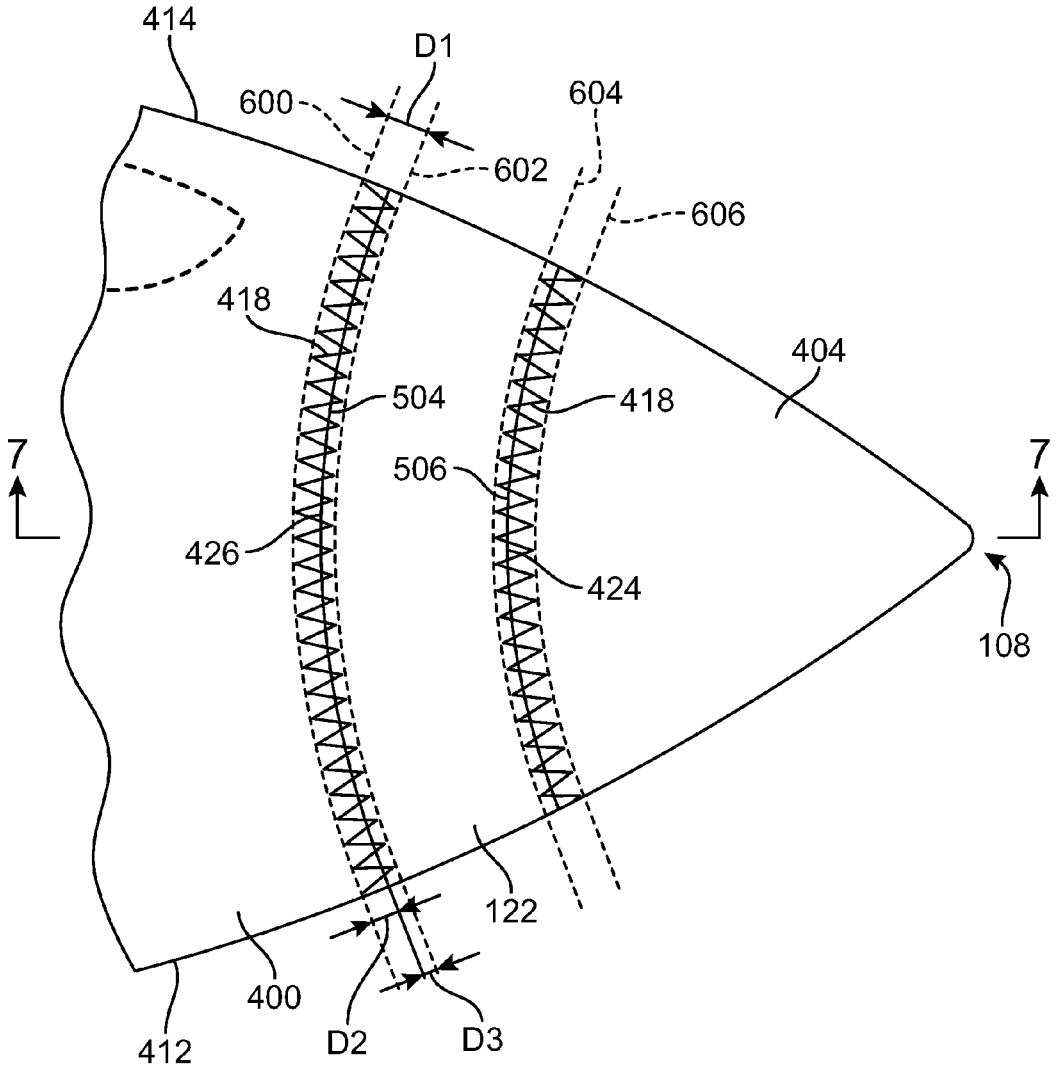
FIG. 6 is an enlarged view of one end of an exemplary embodiment of a segmented cover panel.

In some embodiments, the stripes on the panels of cover 102 may be integrated as part of the panel to form a segmented panel. The stripe piece may simultaneously function as a stripe and a component of the panel itself, in contrast to conventional footballs that include a painted or applied stripe to the surface of the cover. Instead, by forming a panel that includes a stripe piece as a component of the panel, a segmented panel may be obtained that divides the panel into a plurality of different segments. FIGS. 4 through 6 illustrate an exemplary embodiment of a segmented panel for cover 102.

Referring now to FIG. 4, first panel 110 may be a segmented panel that includes one or more stripe pieces dividing first panel 110 into a plurality of segments. In this embodiment, first panel 110 includes a central body segment 400. Central body segment 400 may be associated with a middle of first panel 110 extending between first stripe piece 120 and second stripe piece 122 along longitudinal axis 10. In an exemplary embodiment, central body segment 400 may be the largest portion of first panel 110. In this embodiment, first panel 110 may further include two cone-shaped panel portions or end cone segments, one associated with each of first end 106 and second end 108. First end cone segment 402 may extend between a first tip 406 disposed at first end 106 and first stripe piece 120 and second end cone segment 404 may extend between a second tip 408 disposed at second end 108 and second stripe piece 122.

Central body segment 400 extends between a bottom edge 412 to a top edge 414 of first panel 110 along the transverse axis 20. In some embodiments, central body segment 400 may include a gap 410. In this embodiment, gap 410 may be a cut-out portion of top edge 414 of central body segment 400 that is configured to be associated with lace element 104. In some cases, gap 410 may be provided in first panel 110 and second panel 112 to provide an opening to insert inflatable bladder 300 into the inside of cover 102. In addition, central body segment 400 may be provided with a lacing area 416 disposed adjacent to top edge 414 and/or gap 410. Lacing area 416 may be configured to be associated with one or more holes or perforations for a lace of lace element 104. In some cases, holes or perforations may be stamped or cut out of the material of central body segment 400 at lacing area 416. In other cases, lace element 104 may be adhered or bonded to the surface of central body segment 400 at lacing area 416.

In an exemplary embodiment, each of the separate segments of first panel 110 may be joined together. In this embodiment, first end cone segment 402 may be joined to first stripe piece 120 along a first edge 420 of first end cone segment 402 with stitching 418. Similarly, central body segment 400 may be joined to first stripe piece 120 along a second edge of central body segment 400 with stitching 418 and may also be joined to second stripe piece 122 along a third edge 426 of central body segment 400 with stitching 418. Second end cone segment 404 may be joined to second stripe piece 122 along a fourth edge 424 of second cone segment 404 with stitching 418. With this arrangement, each of the separate segments, including first end cone segment 402, first stripe piece 120, central body segment 400, second stripe piece 122, and second end cone segment 404 may be joined together with stitching 418 to form first panel 110 as a segmented panel.

In other embodiments, separate segments forming cover 102, including one or more of first end cone segment 402, central body segment 400, first stripe piece 120, second stripe piece 122, and/or second end cone segment 404, may be joined together using other attachment mechanisms in addition to, or in place of, stitching, including, but not limited to adhesive, ultrasonic welding, bonding, or other attachment mechanisms known in the art.

In an exemplary embodiment, adjoining edges of each segment are beveled to assist with providing a cover having securely fastened components. Referring now to FIG. 5, an exploded view of an exemplary embodiment of a segmented panel having beveled edges is illustrated. In this embodiment, first panel 110 is shown with component segments, including first end cone segment 402, first stripe piece 120, central body segment 400, second stripe piece 122, and second end cone segment 404, separated from one another. In an exemplary embodiment, adjoining edges of each segment that is to be joined to a stripe piece, including first stripe piece 120 and/or second stripe piece 122 may have corresponding beveled edges.

In some embodiments, the edges of the stripe pieces are beveled with a beveled face oriented in direction facing towards the exterior surface of first panel 110, that is, in the direction facing towards the outside of football 100 when first panel 110 is in an assembled configuration. In contrast, the edges of the panel segments are beveled with a beveled face oriented in a direction facing towards the interior surface of first panel 110, that is, in the direction facing towards the inside of football 100 when first panel 110 is in an assembled configuration.

Referring again to FIG. 5, in this embodiment, first stripe piece 120 includes a first beveled edge 500 and a second beveled edge 502. First beveled edge 500 and second beveled edge 502 are beveled with beveled faces oriented towards the exterior surface of first panel 110. First end cone segment 402 and central body segment 400 are configured to be joined or attached to first stripe piece 120. In this embodiment, first end cone segment 402 includes first edge 420 that is configured to associate with first beveled edge 500 and central body segment 400 includes second edge 422 that is configured to associate with second beveled edge 502. First edge 420 of first end cone segment 402 and second edge of central body segment 400 are beveled with beveled faces oriented towards the interior surface of first panel 110. With this arrangement, the corresponding beveled edges of first edge 420 with first beveled edge 500 and/or second edge 422 with second beveled edge 502 may be securely fastened with one another when joined or attached, for example, using stitching 418 or any other attachment mechanism.

Similarly, second stripe piece 122 may include a third beveled edge 504 and a fourth beveled edge 506. Third beveled edge 504 and fourth beveled edge 506 are beveled with beveled faces oriented towards the exterior surface of first panel 110. Second end cone segment 404 and central body segment 400 are configured to be joined or attached to second stripe piece 122. In this embodiment, central body segment 400 includes third edge 426 that is configured to associate with third beveled edge 504 and second end cone segment 404 includes fourth edge 424 that is configured to associate with fourth beveled edge 506. Third edge 426 of central body segment 400 and fourth edge 424 of second end cone segment 404 are beveled with beveled faces oriented towards the interior surface of first panel 110. With this arrangement, the corresponding beveled edges of third edge 426 with third beveled edge 504 and/or fourth edge 424 with fourth beveled edge 506 may be securely fastened with one another when joined or attached, for example, using stitching 418 or any other attachment mechanism.

Components of cover 102, including panels, are shown in the Figures having a two-dimensional representation. However, when the panels are joined together to form cover 102 and assembled into football 100, each of the panels will have a three-dimensional configuration. Accordingly, the shape of components associated with cover 102, including first panel 110 and other panels, may be configured to take into account this three-dimensional configuration when football 100 is assembled.

For example, as shown in FIGS. 1 and 2, first stripe piece 120 and second stripe piece 122 appear to have an orientation that is substantially aligned along transverse axis 20. However, referring to the flat, two-dimensional representation of first panel 110 shown in FIGS. 3 through 5, first stripe piece 120 and second stripe piece 122 have an arcuate or curved shape, including a convex shape on one side and a concave shape on the opposite side. Similarly, the segments of first panel 110 also have an arcuate or curved shape. First end cone segment 402 and second end cone segment 404 have convex conical shapes. The convex conical shapes of first end cone segment 402 and second end cone segment 404 correspond with the concave shapes on one side of each of first stripe piece 120 and second stripe piece 122. In this embodiment, first edge 420 may be associated with a convex shape and first beveled edge 500 may be associated with a corresponding concave shape. Similarly, fourth edge 424 may be associated with a convex shape and fourth beveled edge 506 may be associated with a corresponding concave shape.

Central body segment 400 has a convex shape along top edge 414 and bottom edge 412 and concave shapes along opposite edges along longitudinal axis 10. These concave shapes of central body segment 400 correspond with the convex shapes on one side of each of first stripe piece 120 and second stripe piece 122. In this embodiment, second edge 422 may be associated with a concave shape and second beveled edge 502 may be associated with a corresponding convex shape. Similarly, third edge 426 may be associated with a concave shape and third beveled edge 504 may be associated with a corresponding convex shape. With this arrangement, the arcuate or curved shapes are configured to take into account the curvature of first panel 110 when assembled into football 100.

Referring now to FIG. 6, an enlarged view of second end 108 of first panel 110 is illustrated. In this embodiment, second stripe piece 122 is joined or attached to central body segment 400 at third edge 426 of central body segment 400 and third beveled edge 504 of second stripe piece 122 using stitching 418. Similarly, second stripe piece 122 is joined or attached to second end cone segment 404 at fourth edge 424 of second end cone segment 404 and fourth beveled edge 506 of second stripe piece 122 also using stitching 418. In different embodiments, stitching 418 may be any kind of stitching. Examples of various stitches that may be used include, but are not limited to: backstitches, basting stitches, blind stitches, buttonhole stitches, chain stitches, cross-stitches, embroidery stitches, feather stitches, hemming stitches, lock stitches, padding stitches, running stitches, slip stitches, stretch stitches, top stitches, whip stitches, zigzag stitches as well as any other types of machine or manual stitches. In this embodiment, stitching 418 may be a zigzag stitch.

In an exemplary embodiment, the location of stitching 418 may be configured to securely fasten the components of first panel 110 to each other. In this embodiment, stitching 418 may be located along a first stitch line 600 on central body segment 400 adjacent to third edge 426 and a second stitch line 602 on second stripe piece 122 adjacent to third beveled edge 504. In an exemplary embodiment, first stitch line 600 and second stitch line 602 may be separated by a first distance D1. In one embodiment, first distance D1 may be approximately 5 mm. In other embodiments, first distance D1 may be from 3 mm to 8 mm. In various embodiments, first distance D1 may be larger or smaller.

In one embodiment, stitching 418 may be offset relative to the joint formed by adjoining edges of central body segment 400 and second stripe piece 122. For example, in one embodiment, first stitch line 600 may extend a larger distance into central body segment 400 than the distance that second stitch line 602 extends into second stripe piece 122. In this embodiment, first stitch line 600 may be located a second distance D2 from third edge 426 and second stitch line 602 may be located a third distance D3 from third beveled edge 504. In an exemplary embodiment, second distance D2 is larger than third distance D3. In one embodiment, second distance D2 may be 4 mm and third distance D3 may be 1 mm. Taken together, second distance D2 and third distance D3 are equal to first distance D1. Accordingly, in other embodiments where first distance D1 is larger or smaller, second distance D2 and/or third distance D3 may be proportionally larger or smaller. In addition, in some embodiments, stitching 418 may not be offset and second distance D2 and third distance D3 may be approximately equal.

Stitching 418 joining second stripe piece 122 to second end cone segment 404 may have a similar configuration. In this embodiment, stitching 418 may be located along a third stitch line 604 on second stripe piece 122 adjacent to fourth beveled edge 506 and a fourth stitch line 606 on second end cone segment 404 adjacent to fourth edge 424. The distance between third stitch line 604 and fourth stitch line 606, may be substantially similar to first distance D1, described above, and the offset configuration, including the distance of third stitch line 604 from fourth beveled edge 506 and the distance of fourth stitch line 606 from fourth edge 424, may be substantially similar to third distance D3 and second distance D2, respectively, described above. In addition, the configuration of stitching 418 attaching first stripe piece 120 to first end cone segment 402 and/or central body segment 400 at first end 106 may have a substantially similar arrangement as described herein with regard to FIG. 6.

Figure 7:
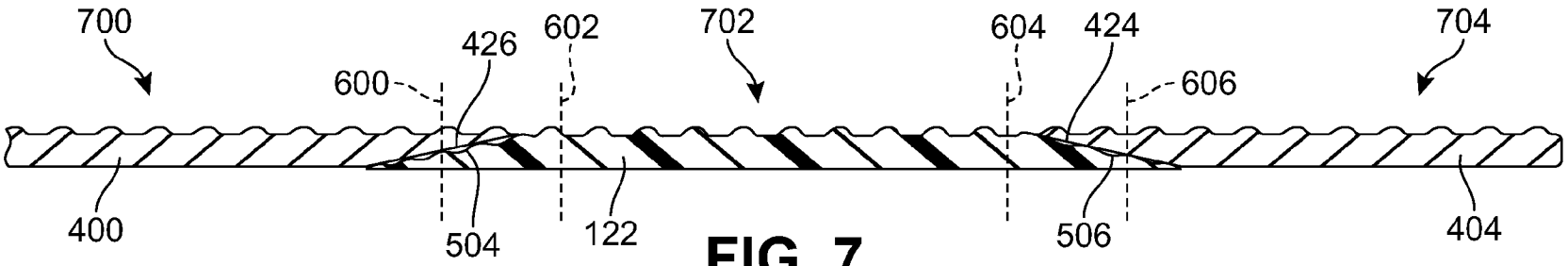
FIG. 7 is a cross-sectional view of FIG. 6.

With this arrangement, in particular, the offset configuration of stitching 418 relative to the joint formed by adjoining edges of the components of first panel 110, the corresponding beveled edges may be securely fastened to each other. Referring now to FIG. 7, a cross-sectional view of FIG. 6 is illustrated. In this embodiment, the location of stitching 418 between first stitch line 600 and second stitch line 602 and the location of stitching 418 between third stitch line 604 and fourth stitch line 606 to join together corresponding beveled edges is shown.

In this embodiment, first stitch line 600 illustrates the path of stitching 418 as it joins central body segment 400 to second stripe piece 122. First stitch line 600 passes through the corresponding beveled faces of third edge 426 of central body segment 400 and third beveled edge 504 of second stripe piece 122. Second stitch line 602 anchors stitching 418 to second stripe piece 122. Similarly, on the other side of second stripe piece 122, fourth stitch line 606 illustrates the path of stitching 418 as it joins second end cone segment 404 to second stripe piece 122. Fourth stitch line 606 passes through the corresponding beveled faces of fourth beveled edge 506 of second stripe piece 122 and fourth edge 424 of second end cone segment 404. Third stitch line 604 anchors stitching 418 to second stripe piece 122. By passing a stitch through the corresponding beveled faces on the adjoining edges of the separate components of first panel 110, the components of first panel 110 may be securely fastened to each other.

In an exemplary embodiment, by joining segments of the panels together using beveled edges in this manner, the top surfaces of adjacent segments may be kept flush with each other to provide a cover having a substantially even exterior surface. As shown in FIG. 7, central body segment 400 may have a first top surface 700 disposed on an exterior-facing portion of first panel 110. Second stripe piece 122, disposed adjacent to central body segment 400, may include a second top surface 702 disposed on an exterior-facing portion of second stripe piece 122. In this embodiment, first top surface 700 of central body segment 400 and second top surface 702 of second stripe piece 122 may be flush with each other to provide a substantially even surface to first panel 110.

Similarly, second end cone segment 404, disposed adjacent to second stripe piece 122 near second end 108, may include a third top surface 704 disposed on an exterior-facing portion of second end cone segment 404. In an exemplary embodiment, third top surface 704 of second end cone segment 404 and second top surface 702 of second stripe piece 122 may be flush with each other to provide a substantially even surface to first panel 110.

In some embodiments, panels of football 100 may include texture to assist with gripability and/or feel of football 100. Examples of texture may include, but are not limited to the inherent grain or texture of the material, for example leather, or imparted texture, for example by providing pebbling, grooves, or other roughening structures to the exterior surface of portions of the panels. In an exemplary embodiment, one or more portions of first panel 110 may include texture. In this embodiment, first top surface 700, second top surface 702, and third top surface 704 include a pebbled texture. In other embodiments, any of the surfaces of components of the panels may have different types or amounts of texture.

Figure 8:
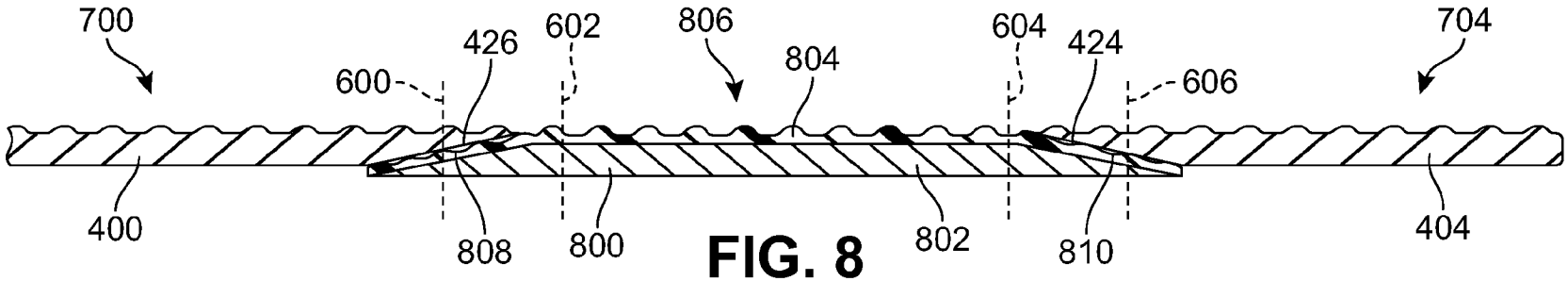
FIG. 8 is an alternate embodiment of a compound stripe piece.

Referring now to FIG. 8, an alternate embodiment of a stripe piece component of a segmented panel for cover 102 of football 100 is illustrated. In this embodiment, a compound stripe piece 800 may be made of multiple layers of material. In an exemplary embodiment, each of central body segment 400 and second end cone segment 404 may be made of a single piece of material, including similar or different materials. Compound stripe piece 800 may be made of two or more pieces of materials disposed in various layers. In this embodiment, compound stripe piece 800 includes a base layer 802 and a surface layer 804.

In an exemplary embodiment, base layer 802 may be a substrate layer made of a material similar to the materials used for the other components of the panel, including a material substantially similar to the materials used for central body segment 400 and/or second end cone segment 404. In one embodiment, surface layer 804 may be disposed on top of base layer 802 to provide an exterior-facing top surface 806. In some embodiments, surface layer 804 may be attached to base layer 802, including using adhesive, bonding, or other attachment mechanisms. In other embodiments, surface layer 804 may be deposited onto base layer 802, including using spraying or molding techniques.

In this embodiment, base layer 802 is leather and top layer 804 is a synthetic leather material. Base layer 802 may be joined with top layer 804 to form compound stripe piece 800. In an exemplary embodiment, the edges of compound stripe piece 800 are formed having beveled edges as described herein. In this embodiment, compound stripe piece 800 includes a first beveled edge 808 and a second beveled edge 810. Second end cone segment 404 and central body segment 400 are configured to be joined or attached to compound stripe piece 800 in a similar manner as described above in regard to second stripe piece 122. In this embodiment, central body segment 400 includes third edge 426 that is configured to associate with first beveled edge 808 using stitching 418 along first stitch line 600 and second stitch line 602. Similarly, second end cone segment 404 includes fourth edge 424 that is configured to associate with second beveled edge 810 using stitching 418 along third stitch line 606 and fourth stitch line 608.

In an exemplary embodiment, each of top surface 806, first top surface 700 and/or third top surface 704 may be configured to be flush with each other to provide a substantially even surface to first panel 110, as described above in regard to FIG. 7. In some embodiments, compound stripe piece 800 may be configured with surface layer 804 made of a material having top surface 806 that includes different amount of texture or a material with a different gripability than the adjacent surfaces. With this arrangement, top surface 806 may be provided to have a larger coefficient of friction than either or both of first top surface 700 and/or third top surface 704 of the adjacent component panel segments.

Figure 9:
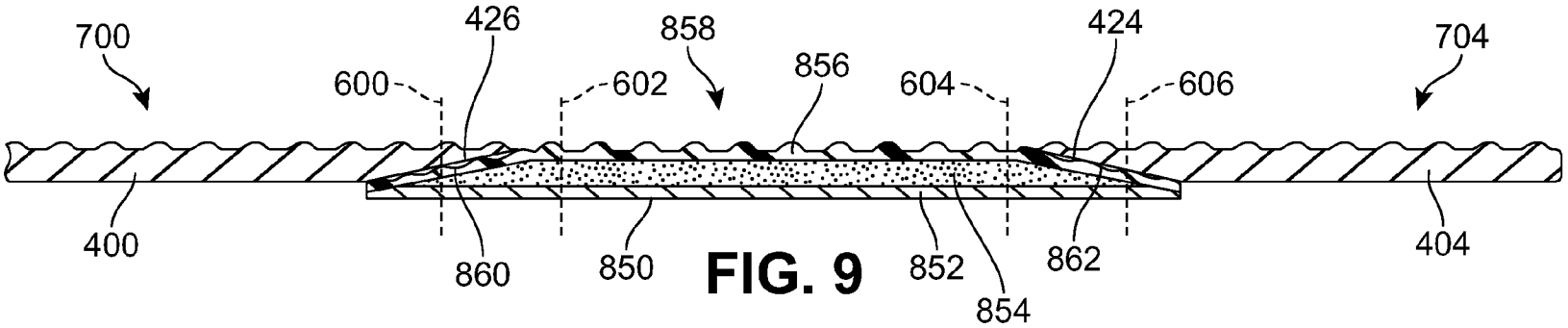
FIG. 9 is an alternate embodiment of a padded stripe piece.

Referring now to FIG. 9, an alternate embodiment of a stripe piece component of a segmented panel for cover 102 of football 100 is illustrated. In this embodiment, a padded stripe piece 850 may be made of multiple layers of material. In an exemplary embodiment, each of central body segment 400 and second end cone segment 404 may be made of a single piece of material, including similar or different materials. Padded stripe piece 850 may be made of three or more pieces of materials disposed in various layers. In this embodiment, padded stripe piece 850 includes a lining layer 852, a padding layer 854, and a surface layer 856. In an exemplary embodiment, padding layer 854 may be disposed between lining layer 852 and surface layer 856.

In an exemplary embodiment, lining layer 852 may be an inner lining made of a woven or non-woven textile material configured to provide strength to padded stripe piece 850. In one embodiment, lining layer 852 may be made of natural or synthetic materials, including, but not limited to leather, polyester, polyethylene fiber, or any materials used for the other components of the panel, including a material substantially similar to the materials used for central body segment 400 and/or second end cone segment 404.

In an exemplary embodiment, padded stripe piece 850 may be provided with padding layer 854 disposed between lining layer 852 and surface layer 854 and configured to provide resilience and cushioning to padded stripe piece 850. In one embodiment, padding layer 854 may be made of a natural or synthetic material, including, but not limited to foam, for example, polyurethane foam, ethylene vinyl acetate (EVA), thermoplastic polyurethane (TPU), or other resilient materials. In an exemplary embodiment, surface layer 856 may be disposed on top of padded stripe piece 850, above padding layer 854 and lining layer 852, to provide an exterior-facing top surface 858. In one embodiment, surface layer 856 may be made of a natural or synthetic material, including, but not limited to rubber, TPU, polyurethane, or any combination of materials, including materials used to make other components of cover 102.

In some embodiments, surface layer 856 may be attached to lining layer 852 along the edges of padded stripe piece 850 and/or may be attached to padding layer 854. Attachment of surface layer 856 to lining layer 852 and/or padding layer 854 may include using adhesive, ultrasonic welding, bonding, or other attachment mechanisms. In other embodiments, padding layer 854 may be deposited into the space between lining layer 852 and surface layer 856, including using spraying or molding techniques.

In this embodiment, lining layer 852 is a polyester or polyurethane textile material and surface layer 856 is a synthetic leather material. Lining layer 852 may be joined with padding layer 854 and surface layer 856 to form padded stripe piece 850. In an exemplary embodiment, the edges of padded stripe piece 850 are formed having beveled edges as described herein. In this embodiment, padded stripe piece 850 includes a first beveled edge 860 and a second beveled edge 862. Second end cone segment 404 and central body segment 400 are configured to be joined or attached to padded stripe piece 850 in a similar manner as described above in regard to second stripe piece 122. In this embodiment, central body segment 400 includes third edge 426 that is configured to associate with first beveled edge 860 using stitching 418 along first stitch line 600 and second stitch line 602. Similarly, second end cone segment 404 includes fourth edge 424 that is configured to associate with second beveled edge 862 using stitching 418 along third stitch line 606 and fourth stitch line 608.

In an exemplary embodiment, each of top surface 858, first top surface 700 and/or third top surface 704 may be configured to be flush with each other to provide a substantially even surface to first panel 110, as described above in regard to FIG. 7. In some embodiments, padded stripe piece 850 may be configured with surface layer 856 made of a material having top surface 858 that includes different amount of texture or a material with a different gripability than the adjacent surfaces. With this arrangement, top surface 858 may be provided to have a larger coefficient of friction than either or both of first top surface 700 and/or third top surface 704 of the adjacent component panel segments.

Figure 10:
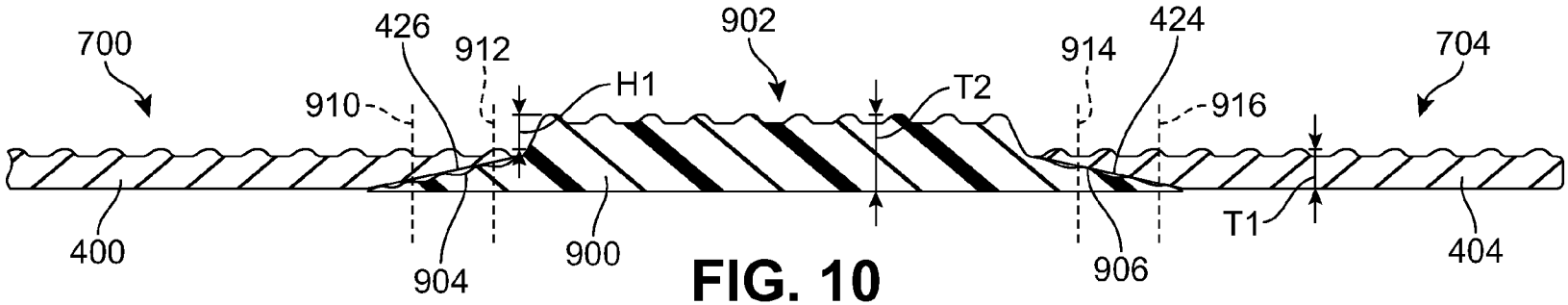
FIG. 10 is an alternate embodiment of a raised stripe piece.

In some embodiments, a stripe piece may be configured to be raised above the surfaces of adjacent panel segments. Referring now to FIG. 10, an alternate embodiment of a raised stripe piece 900 is illustrated. In this embodiment, raised stripe piece 900 is raised above adjoining segments, including central body segment 400 and/or second end cone segment 404. For example, central body segment 400 and/or second end cone segment 404 may be associated with a first thickness T1. Raised stripe piece 900 may be associated with a second thickness T2. In an exemplary embodiment, second thickness T2 may be larger than first thickness T1 so that a top surface 902 of raised stripe piece 900 extends above first top surface 700 of central body segment 400 and/or third top surface 704 of second end cone segment 404 by a first height H1. With this arrangement, raised stripe piece 900 may be configured to assist with providing additional gripability.

In different embodiments, raised stripe piece 900 may be a single piece of material or may be a compound stripe piece of two or more materials. In an exemplary embodiment, the edges of raised stripe piece 900 are formed having beveled edges as described herein. In this embodiment, raised stripe piece 900 includes a first beveled edge 904 and a second beveled edge 906. Second end cone segment 404 and central body segment 400 are configured to be joined or attached to raised stripe piece 900 in a similar manner as described above in regard to second stripe piece 122 and/or compound stripe piece 800. In this embodiment, central body segment 400 includes third edge 426 that is configured to associate with first beveled edge 904 using stitching 418 along a first stitch line 910 and a second stitch line 912. Similarly, second end cone segment 404 includes fourth edge 424 that is configured to associate with second beveled edge 906 using stitching 418 along third stitch line 914 and fourth stitch line 916.

In contrast to previous embodiments, in the embodiment shown in FIG. 10, the stitch lines for stitching 418 attaching raised stripe piece 900 to adjacent segments may not extend onto top surface 902. In this embodiment, first stitch line 910 and second stitch line 912 both pass through third edge 426 and first beveled edge 904 and third stitch line 914 and fourth stitch line 916 similarly passes through both fourth edge 424 and second beveled edge 906. With this arrangement, raised stripe piece 900 may be securely fastened to the adjoining segments to form a panel for cover 102 of football 100.

Figure 11:
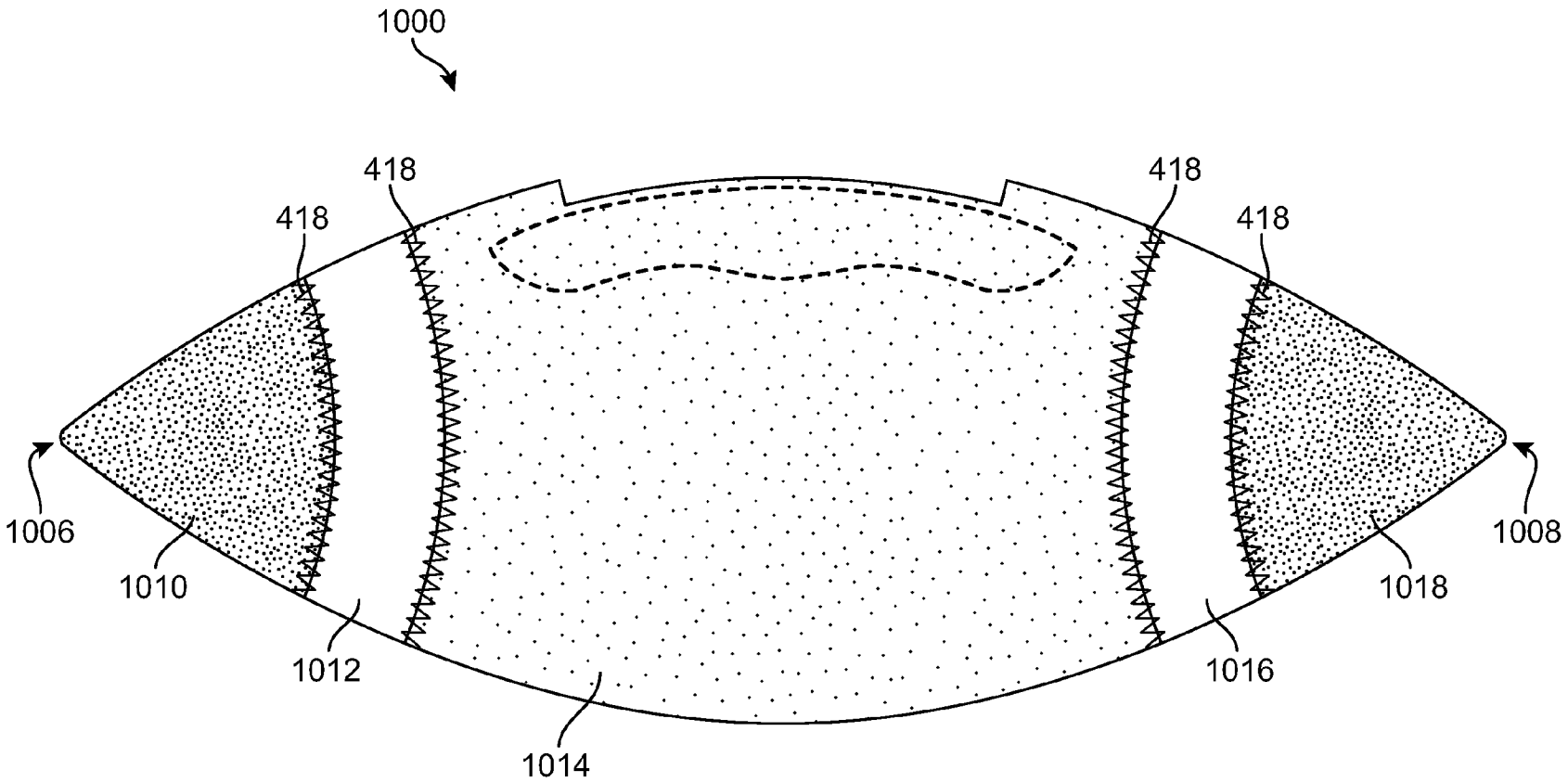
FIG. 11 is an alternate embodiment of a segmented cover panel having different segment characteristics.

Using the beveled edge attachment arrangement for joining stripe pieces to adjacent segments, a segmented panel may be provided that securely fastens multiple component pieces. In particular, a segmented panel arrangement may allow a football to include one or more panels having different material characteristics associated with the various segment component pieces. Referring now to FIG. 11, an alternate embodiment of a segmented panel 1000 is illustrated. In some embodiments, segmented panel 1000 may include segment component pieces having different material characteristics associated with the various segments of panel 1000. Material characteristics may include, but are not limited to, choice of materials, including materials having different coefficients of friction to provide different gripability, and/or choice of colors, to provide better visibility to specific portions, for example, ends of a football. Other material characteristics may include padding, stiffness, durability, as well as other properties.

As shown in FIG. 11, segmented panel 1000 may include a central body segment 1014. Central body segment 1014 may be substantially similar to central body segment 400, described above. Segmented panel 1000 may also include a first end cone segment 1010 at a first end 1006 of segmented panel 1000 and a second end cone segment 1018 at a second end 1008. First end cone segment 1010 and second end cone segment 1018 may be substantially similar to first end cone segment 402 and second end cone segment 404, described above.

In addition, segmented panel 1000 may further include a first stripe piece 1012 disposed between first end cone segment 1010 and central body segment 1014 near first end 1006 and a second stripe piece 1016 disposed between second end cone segment 1018 and central body segment 1014 near second end 1008. First stripe piece 1012 and second stripe piece 1016 may be substantially similar to first stripe piece 120 and second stripe piece 122, described above. In addition, first stripe piece 1012 and/or second stripe piece 1016 may include alternate embodiments of stripe pieces described above, including compound stripe piece 800 and/or raised stripe piece 900.

With this arrangement, the various segment component pieces may be associated with different material characteristics to form segmented panel 1000. For example, in one embodiment, first end cone segment 1010 and/or second end cone segment 1018 may be made of a first material having an associated characteristic. In an exemplary embodiment, the first material may be leather and the characteristic may be a first color. Central body segment 1014 may be made of a second material having an associated characteristic. In some cases, the first material and the second material, may be different. In other cases, the first material and the second material may be substantially similar. In a similar manner, in various embodiments, the associated characteristics may be different or may be substantially similar. In an exemplary embodiment, the second material may be leather and the characteristic may be a second color. The second color associated with the second material of central body segment 1014 may be different than the first color associated with the first material of first end cone segment 1010 and/or second end cone segment 1018. This arrangement may assist with visibility of the football.

In addition, stripe pieces may also be made of different materials than one or more of the other segments of segmented panel 1000. In one embodiment, first stripe piece 1012 and/or second stripe piece 1016 may be made of a third material having an associated characteristic. In an exemplary embodiment, the third material may be synthetic leather and the characteristic may be coefficient of friction. As noted above, first end cone segment 1010 and/or second end cone segment 1018 may be made of a first material having an associated characteristic and central body segment 1014 may be made of a second material having an associated characteristic. In some cases, the third material and the first material and/or second material, may be different. In other cases, the third material and the first material and/or second material may be substantially similar. In a similar manner, in various embodiments, characteristics may be different or may be substantially similar. In an exemplary embodiment, first material and/or second material may be natural leather and the characteristic may be coefficient of friction. The coefficient of friction associated with the first material and/or second material may be smaller than the coefficient of friction associated with the first material of first stripe piece 1012 and/or second stripe piece 1016. With this arrangement, the gripability of a football with a segmented panel may be increased.

Figure 12:
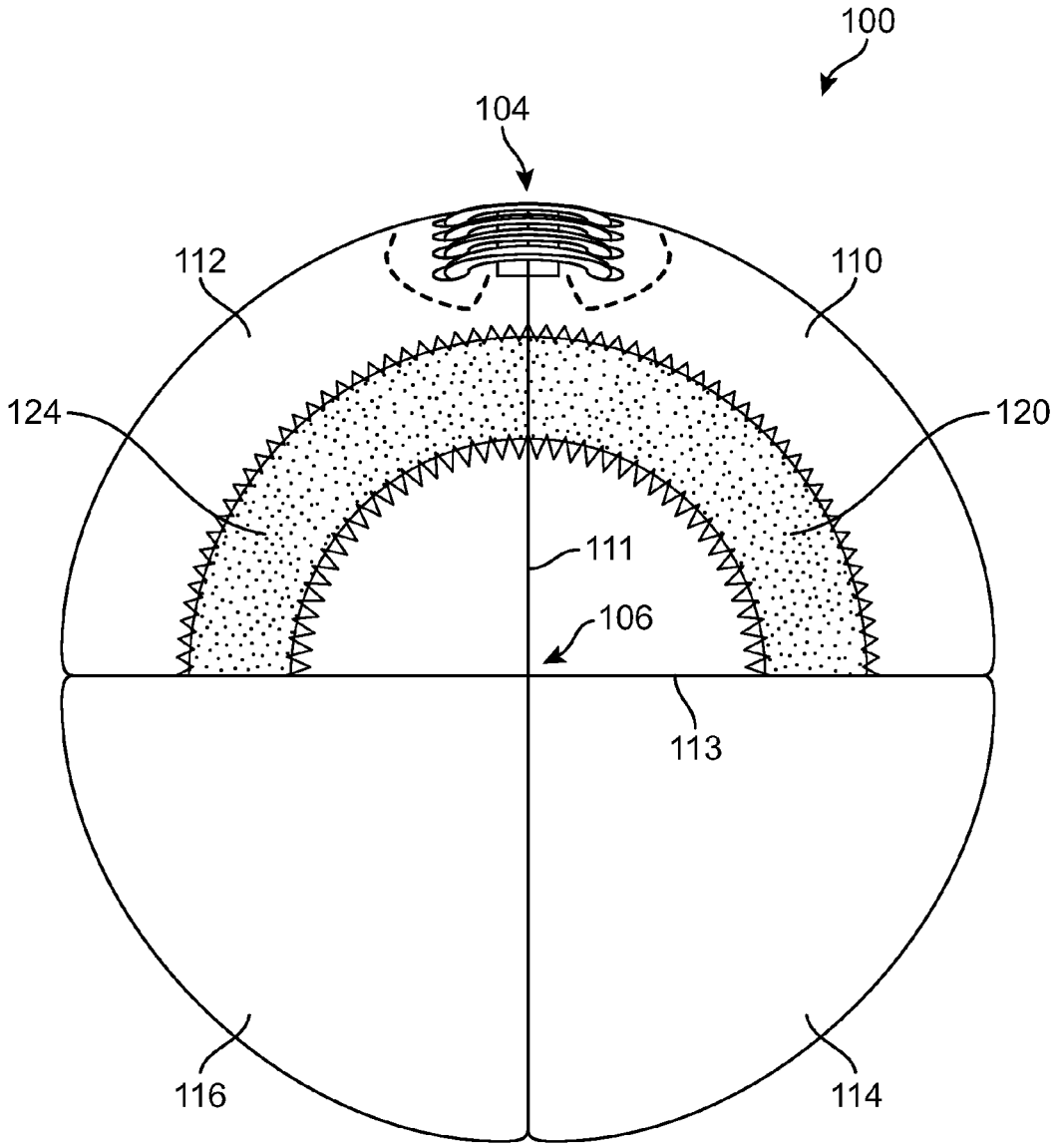
FIG. 12 is an end view of an exemplary embodiment of a football having segmented cover panels.

In an exemplary embodiment, an assembled football may include one or more panels with the arrangements described herein. Referring now to FIG. 12, football 100 is illustrated as an end view towards first end 106. In this embodiment, football 100 includes stripes extending around the circumference on two of four panels, in accordance with NCAA rules, as described above. As shown in FIG. 12, first panel 110 and second panel 112 disposed on the top side of football 100 near lace element 104 include first stripe piece 120 and third stripe piece 124. First panel 110 and second panel 112 may be joined to each other along seam 111. In contrast, third panel 114 and fourth panel 116 disposed on the bottom side of football 100 opposite lace element 104 do not include stripe pieces. Third panel and fourth panel 116 may be joined along seam 111. In addition, the top half of football 100, including first panel 110 and second panel 112, may be joined to the bottom half of football 100, including third panel 114 and fourth panel 116, along seam 113.

FIG. 13 illustrates an alternate embodiment of a football 1200 that includes stripes on four of four panels, extending around substantially all of the circumference of football 1200. As shown in FIG. 13, a first panel 1210 and a second panel 1212 disposed on the top side of football 1200 near lace element 104 include a first stripe piece 1220 and fourth stripe piece 1226. In contrast to FIG. 12, third panel 1214 and fourth panel 1216 disposed on the bottom side of football 1200 opposite lace element 104 may also include stripe pieces, a second stripe piece 1222 and a third stripe piece 1224. Each of the separate panels of football 1200 may be joined along seams in a similar manner as football 100.

In addition, in other embodiments, stripes may extend through three of four panels. In still other embodiments, a football may have a larger or smaller number of panels, including with or without stripes, to provide footballs of various configurations.

In some embodiments, various elements may be applied or formed into one or more of the stripe pieces associated with a football. Elements may be functional, for example to provide texture for increased gripability, and elements may also be ornamental, for example to provide different colors, graphics, logos, or other symbols and/or designs onto the stripe piece of a football.

Figure 14:
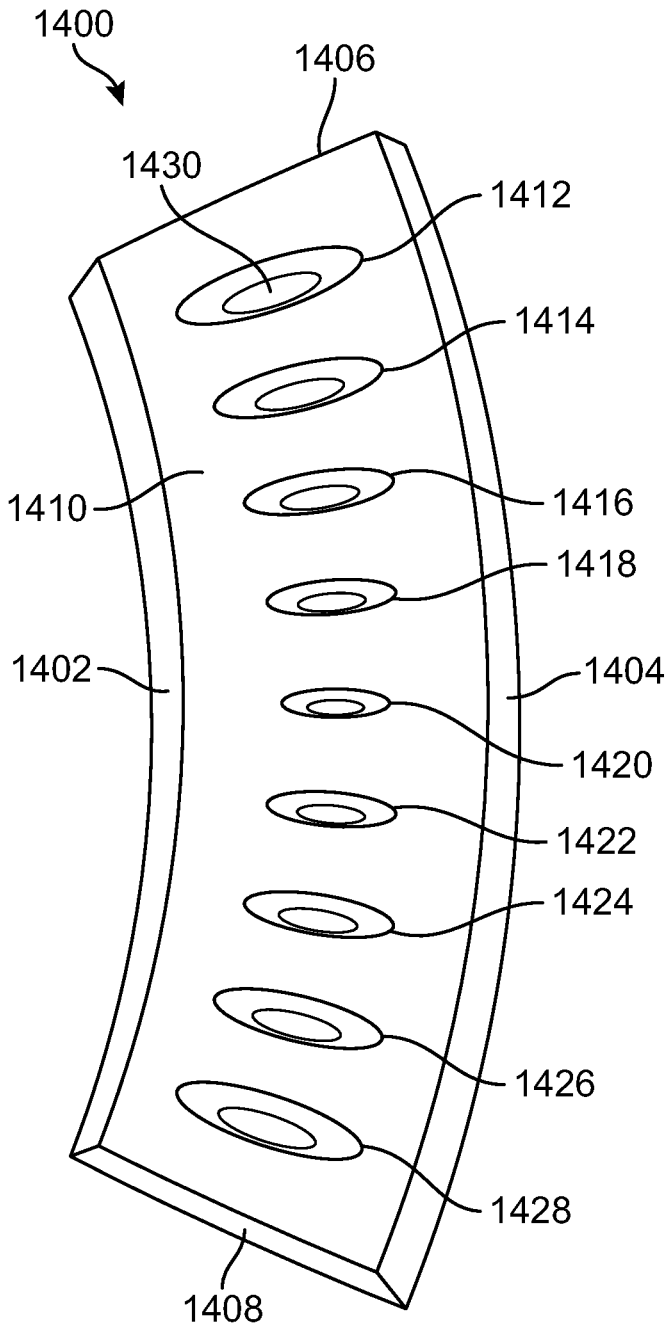
FIG. 14 is an alternate embodiment of a textured stripe piece.

Referring now to FIG. 14, an alternate embodiment of a textured stripe piece 1400 is illustrated. In an exemplary embodiment, textured stripe piece 1400 may include beveled edges, as described above in regard to first stripe piece 120, including a first beveled edge 1402 and a second beveled edge 1404. In this embodiment, textured stripe piece 1400 includes a plurality of texture elements arranged along the length of textured stripe piece 1400 extending between a first end 1406 and a second end 1408. In an exemplary embodiment, plurality of texture elements may be thermoformed or debossed into a top surface 1410 of textured stripe piece 1400. In some cases, the plurality of texture elements may be provided on textured stripe piece 1400 prior to assembly with other components to form a cover. In other cases, the plurality of texture elements may be provide on textured stripe piece 1400 after assembly with the other components of the cover.

In this embodiment, the plurality of texture elements have an elliptical or ovoid shape. In other embodiments, one or more texture elements may have different shapes, including, but not limited to triangular, hexagonal, circular, square, rectangular, trapezoidal, diamond, as well as other regular or irregular and geometric or non-geometric shapes and/or designs. In addition, in other embodiments, plurality of texture elements may further include graphics or other ornamental designs.

In this embodiment, textured stripe piece 1400 includes a first texture element 1412 disposed adjacent to first end 1406, a second texture element 1414 disposed adjacent to first texture element 1412, a third texture element 1416 disposed adjacent to second texture element 1414, a fourth texture element 1418 disposed adjacent to third texture element 1416, a fifth texture element 1420 disposed adjacent to fourth texture element 1418, a sixth texture element 1422 disposed adjacent to fifth texture element 1420, a seventh texture element 1424 disposed adjacent to sixth texture element 1422, an eighth texture element 1426 disposed adjacent to seventh texture element 1424, and a ninth texture element 1428 disposed adjacent to second end 1408.

In an exemplary embodiment, each of the plurality of texture elements may be depressed below top surface 1410 of textured stripe piece 1400 to provide a depression or indentation in top surface 1410. In this embodiment, first texture element 1412 includes a bottom surface 1430 that is disposed below top surface 1410. In one embodiment, bottom surface 1430 may be disposed approximately 1 mm to 2 mm below top surface 1410. In other embodiments, bottom surface 1430 may be disposed a smaller or larger distance below top surface 1410. In a similar manner, each of the plurality of texture elements, including second texture element 1414, third texture element 1416, fourth texture element 1418, fifth texture element 1420, sixth texture element 1422, seventh texture element 1424, eighth texture element 1426, and/or ninth texture element 1428 may be depressed below top surface 1410. In addition, in various embodiments, one or more texture elements may be depressed below top surface 1410 by different amounts.

In some embodiments, the plurality of texture elements may be configured to provide varying amounts of texture along the length of textured stripe piece 1400. In an exemplary embodiment, the size of individual texture elements may be varied along the length of textured stripe piece 1400. In one embodiment, larger texture elements may be provided near each of first end 1406 and second end 1408 and smaller texture elements may be provided near the middle of textured stripe piece 1400. In some cases, the size may be varied by providing two or more sized texture elements. In other cases, the size may be varied in an approximately continuously manner in relation to the distance from each end of textured stripe piece 1400.

In this embodiment, the size of texture elements vary in an approximately continuously manner in relation to the distance from first end 1406 and/or second end 1408. First texture element 1412 adjacent first end 1406 and ninth texture element 1428 adjacent second end 1408 are larger in size than the remaining plurality of texture elements. Similarly, second texture element 1414 and eighth texture element 1426 are smaller than first texture element 1412 and ninth texture element 1428, but larger than the remaining plurality of texture elements. Such an arrangement may continue inwards along textured stripe piece 1400 with fifth texture element 1420 disposed approximately in the middle of textured stripe piece 1400 being smaller than all of the other texture elements.

In other embodiments, a pair of textured stripe pieces may be provided with texture elements of varying sizes to provide a similar arrangement as described in FIG. 14 over two adjacent stripe panels. For example, the sizes of texture elements may decrease in size from opposing ends of adjacent stripe panels towards adjacent ends where the sizes of texture elements may be relatively smaller than the texture elements disposed near the opposing ends. In still other embodiments, different arrangements of size and/or shape of texture elements may be provided, including texture elements of similar or different sizes and/or shapes.

In addition, while the present embodiment has been described in reference to providing a depression or indentation using thermoforming or debossing techniques, similar concepts may be applied to embodiments that provide a raised or embossed texture element to a top surface of a stripe piece.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A prolate spheroidal inflatable game ball comprising:

a cover, the cover comprising a plurality of panels; and an inflatable bladder disposed inside the cover;

wherein at least one panel of the plurality of panels includes a stripe piece disposed between an end cone segment and a central body segment along a longitudinal axis;

wherein edges of the stripe piece are joined to an edge of the end cone segment and an edge of the central body segment;

wherein the end cone segment and the central body segment of the at least one panel are separate components joined together;

wherein the edges of the stripe piece are beveled, forming a first beveled edge and a second beveled edge;

wherein the edge of the end cone segment is beveled forming a third beveled edge and the edge of the central body segment is beveled forming a fourth beveled edge;

wherein the first beveled edge of the stripe piece corresponds to the third beveled edge of the end cone segment and the second beveled edge of the stripe piece corresponds to the fourth beveled edge of the central body segment;

wherein the edges of the stripe piece are joined to the edge of the first end cone segment and the edge of the central body segment with stitching; and wherein the stripe piece is joined to the central body segment with stitching having a first stitch line extending through a full thickness of the stripe piece and a second stitch line extending through the fourth beveled edge of the central body segment and through the second beveled edge of the stripe piece.

2. The prolate spheroidal inflatable game ball according to claim 1, wherein a junction between the stripe piece and the edge of the central body segment forms a joint; and wherein the stitching is offset relative to the joint.

3. The prolate spheroidal inflatable game ball according to claim 1, wherein the second beveled edge of the stripe piece extends under at least a portion of the fourth beveled edge of the central body segment.

4. The prolate spheroidal inflatable game ball according to claim 1, wherein a junction between the stripe piece and the edge of the end cone segment forms a joint; and wherein the stitching is offset relative to the joint.

5. A football comprising:

an inflatable bladder;

a plurality of panels surrounding the inflatable bladder forming a cover;

at least two panels of the plurality of panels each including a first stripe disposed at a first end of the panel, and a second stripe disposed at a second end of the panel;

wherein each of the at least two panels comprises:

a first stripe piece forming the first stripe and disposed between a first end cone segment and a central body segment at a first end of the panel; and a second stripe piece forming the second stripe and disposed between a second end cone segment and the central body segment at a second end of the panel;

wherein the first end cone segment, the second end cone segment, and the central body segment are oriented with a length along a longitudinal axis;

wherein the first stripe piece and the second stripe piece are oriented with a length along a transverse axis;

wherein the first end cone segment, the second end cone segment, and the central body segment are separate components joined together by the first stripe piece and the second stripe piece;

wherein the first end cone segment includes a first beveled edge;

wherein the first stripe piece includes a second beveled edge and a third beveled edge, the second beveled edge of the first stripe piece being joined to the first beveled edge of the first end cone segment with stitching:

wherein the central body segment includes a fourth beveled edge and a fifth beveled edge, the fourth beveled edge being joined to the third beveled edge of the first stripe piece with stitching;

wherein the second stripe piece includes a sixth beveled edge and a seventh beveled edge, the sixth beveled edge being joined to the fifth beveled edge of the central body segment with stitching;

wherein the second end cone segment includes an eighth beveled edge joined to the seventh beveled edge of the second stripe piece with stitching; and wherein the stripe piece is joined to the first end cone segment with stitching having a first stitch line extending through a full thickness of the first stripe piece and a second stitch line extending through the first beveled edge of the first end cone segment and through the second beveled edge of the first stripe piece.

6. The football according to claim 5, wherein the second beveled edge of the first stripe piece extends under at least a portion of the first beveled edge of the first end cone segment.

7. The football according to claim 6, wherein the third beveled edge of the first stripe piece is joined to the fourth beveled edge of the central body segment with stitching having a third stitch line extending through a full thickness of the first stripe piece and a fourth stitch line extending through the third beveled edge of the first stripe piece and through the fourth beveled edge of the first central body segment.

8. The football according to claim 5, wherein the third beveled edge of the first stripe piece extends under the fourth beveled edge of the central body segment.

9. The football according to claim 8, wherein the stitching joining the first stripe piece to the central body segment extends between a third stitch line disposed on the first stripe piece and a fourth stitch line disposed on the central body segment; and wherein the stitching joining the first stripe piece to the edge of the central body segment at the first stitch line extends through a full thickness of the first stripe piece, and the second stitch line extends through the third beveled edge of the first stripe piece and through the fourth beveled edge of the central body segment.

10. The football according to claim 5, wherein a top surface of the first stripe piece is flush with a top surface of the first end cone segment and a top surface of the central body segment.

11. A prolate spheroidal inflatable game ball, comprising:

an inflatable bladder;

a plurality of panels joined together to form a cover;

at least one panel of the plurality of panels comprising a segmented panel;

the segmented panel comprising a plurality of component pieces joined together to form the segmented panel, the plurality of component pieces including:

a first end cone segment disposed at a first end of the segmented panel;

a first stripe piece joined to the first end cone segment along a first edge with stitching and joined to a central body segment along a second edge with stitching;

the central body segment extending between the first stripe piece and a second stripe piece;

the second stripe piece joined to the central body segment along a third edge with stitching and joined to a second end cone segment along a fourth edge with stitching; and the second end cone segment being disposed at a second end of the segmented panel;

wherein the first edge, the second edge, the third edge, and the fourth edge are beveled;

wherein the first stripe piece is joined to the first end cone segment with stitching having a first stitch line extending through a full thickness of the first stripe piece and a second stitch line extending through the beveled edge of the first end cone segment and through the beveled first edge of the first stripe piece.

12. The prolate spheroidal inflatable game ball according to claim 11, wherein the first end cone segment comprises a first material, the first stripe piece comprises a second material, and the central body segment comprises a third material; and wherein the first material and the third material are each different from the second material.

13. The prolate spheroidal inflatable game ball according to claim 12, wherein the second material has a coefficient of friction that is greater than the coefficient of friction associated with the first material and the third material.

14. The prolate spheroidal inflatable game ball according to claim 12, wherein the first material is different than the third material.

15. The prolate spheroidal inflatable game ball according to claim 11, wherein at least one of the first stripe piece and the second stripe piece includes a plurality of texture elements.

16. The prolate spheroidal inflatable game ball according to claim 15, wherein the plurality of texture elements comprise at least one depression disposed below a top surface of the first stripe piece and/or the second stripe piece.

17. The prolate spheroidal inflatable game ball according to claim 16, wherein the depression is formed in the top surface using at least one of thermoforming or debossing.

18. The prolate spheroidal inflatable game ball according to claim 15, wherein the size of the plurality of texture elements vary along a length of the first stripe piece and/or the second stripe piece.

19. The prolate spheroidal inflatable game ball according to claim 18, wherein a first texture element disposed at a first end of the least one of the first stripe piece and the second stripe piece is larger than a second texture element disposed at a middle of the least one of the first stripe piece and the second stripe piece.

* * * * *